US006189351B1

(12) United States Patent
Eagan et al.

(10) Patent No.: US 6,189,351 B1
(45) Date of Patent: Feb. 20, 2001

(54) DOOR LOCK WITH CLUTCHING MECHANISM

(75) Inventors: Bruce P. Eagan, Colorado Springs, CO (US); James J. Legner, Princeton, IL (US); Dario Pompeii, Colorado Springs, CO (US)

(73) Assignee: Schlage Lock Company, San Francisco, CA (US)

( * ) Notice: Under 35 U.S.C. 154(b), the term of this patent shall be extended for 0 days.

(21) Appl. No.: 09/341,819

(22) PCT Filed: Jan. 27, 1998

(86) PCT No.: PCT/US98/01475

§ 371 Date: Jul. 19, 1999

§ 102(e) Date: Jul. 19, 1999

(87) PCT Pub. No.: WO98/32938

PCT Pub. Date: Jul. 30, 1998

Related U.S. Application Data

(60) Provisional application No. 60/036,435, filed on Jan. 27, 1997.

(51) Int. Cl.[7] ..... E05B 13/10

(52) U.S. Cl. ..... 70/472; 70/223; 70/224; 70/DIG. 42; 292/DIG. 27; 292/DIG. 62

(58) Field of Search ..... 70/224, 472, 149, 70/221–223, 422, DIG. 42, DIG. 27, DIG. 62

(56) References Cited

U.S. PATENT DOCUMENTS 1,714,286 * 5/1929 Waldo .
2,065,683 * 12/1936 Gahagan ..... 70/224
3,621,685 * 11/1971 Sargent ..... 70/422 X
3,955,387 * 5/1976 Best et al. ..... 70/224
4,195,502 * 4/1980 Best et al. ..... 70/224
4,312,201 * 1/1982 Roos ..... 70/224 X
4,424,691 * 1/1984 Foshee ..... 70/224
4,428,212 * 1/1984 Best et al. ..... 70/224
4,921,289 * 5/1990 Shen ..... 292/336.3
5,177,987 * 1/1993 Shen ..... 70/224
5,322,333 * 6/1994 Norton, III et al. ..... 292/336.3
5,372,025 * 12/1994 Lin ..... 70/472
5,481,890 * 1/1996 Millman ..... 70/224
5,768,926 * 6/1998 Shen ..... 70/224 X
5,794,472 * 8/1998 Kester et al. ..... 70/472
5,809,815 * 9/1998 Lee ..... 70/224 X
5,916,281 * 6/1999 Kester et al. ..... 70/224

FOREIGN PATENT DOCUMENTS

3717778 * 12/1988 (DE) ..... 70/224
0341656 * 11/1989 (EP) .

* cited by examiner

*Primary Examiner*—Lloyd A. Gall
(74) *Attorney, Agent, or Firm*—Michael H. Minns

(57) ABSTRACT

A door lock having a clutching mechanism for selectively engaging and disengaging the outer handle of the lock from a key spindle having latch scoops for operably engaging a latch slide. The key spindle contains a cam mechanism for moving a dogging arm from a clutched position where the outer handle through a keyed outer spindle is keyed to the key spindle to an unclutched position where the dogging arm is positioned within a circumferentially extending slot which permits about 60° rotation of the outer handle relative to the key spindle without movement of the key spindle. Hard stops are provided on an outer driver and outer hub which limit movement of the outer handle to less than the rotation permitted by the clutching mechanism.

8 Claims, 5 Drawing Sheets

DOOR LOCK WITH CLUTCHING MECHANISM

This is a 371 of PCT/US/98/01475 filed on Jan. 27, 1998 and a provision of Ser. No. 60/036,435 filed Jan. 27, 1997.

BACKGROUND OF THE INVENTION

This invention relates generally to door locks and more particularly to door locks having a clutching mechanism for selectively connecting and disconnecting an external handle from a key spindle.

In response to the American with Disabilities Act and other state and local codes, levers have virtually replaced knobs in the marketplace. The benefit of added grip and leverage that levers provide to those with limited mobility has, however, created an opportunity for increased abuse or vandalism. This abuse often renders the lock inoperable and, in some cases, violates the security of the door, leaving computer and laboratory equipment susceptible to theft.

The foregoing illustrates limitations known to exist in present levered door locks. Thus, it is apparent that it would be advantageous to provide an alternative directed to overcoming one or more of the limitations set forth above. Accordingly, a suitable alternative is provided including features more fully disclosed hereinafter.

One prior art clutching door lock is described in U.S. Pat. No. 4,920,773, Surko et al. Surko discloses a clutching mechanism where a radially extending dog extends through a T-shaped slot in an outer spindle to connect a lever to the outer spindle. Another example of a clutching door lock is described in U.S. Pat. No. 2,998,274, Tornoe et al. Tornoe discloses a clutching mechanism having a center spindle that telescopes within the outside spindle and is selectively clutched to the outside spindle. A third example of a clutching door lock is described in U.S. Pat. No. 2,998,274, Russell. Russell discloses clutching an outside spindle to a telescoped center spindle by a clutch consisting of a finger and a notch comprising a longitudinal slot and an adjoining circumferential space. An example of a lock camming mechanism is described in International Patent Application WO 98/02630, published Jan. 22, 1998. U.S. Pat. No. 4,424,691 discloses: a door lock comprising: an inner handle; an outer handle; a chassis containing a latch retractor; an inner spindle having a latch scoop thereon, the latch scoop being operably connected to the latch retractor, the inner spindle being keyed to the inner handle; an outer spindle being keyed to the outer handle; a key spindle positioned within the outer spindle, the key spindle having a latch scoop thereon, the latch scoop being operably connected to the latch retractor, and having a cat therein and a key operated cylinder operably connected to the cam.

SUMMARY OF THE INVENTION

In one aspect of the present invention, this is accomplished by providing a door lock comprising: an inner handle; an outer handle; a chassis containing a latch retractor; an inner spindle having latch scoops thereon, the latch scoops being operably connected to the latch retractor, the inner spindle being keyed to the inner handle; an outer spindle being keyed to the outer handle; a key spindle positioned within the outer spindle, the key spindle having two latch scoops thereon, the latch scoops being operably connected to the latch retractor, and having a cam therein; and a key operated cylinder operably connected to the cam.

The foregoing will become apparent from the following detailed description of the invention when considered in conjunction with the accompanying drawing figures.

BRIEF DESCRIPTION OF THE DRAWING FIGURES

DETAILED DESCRIPTION

Figure 1:
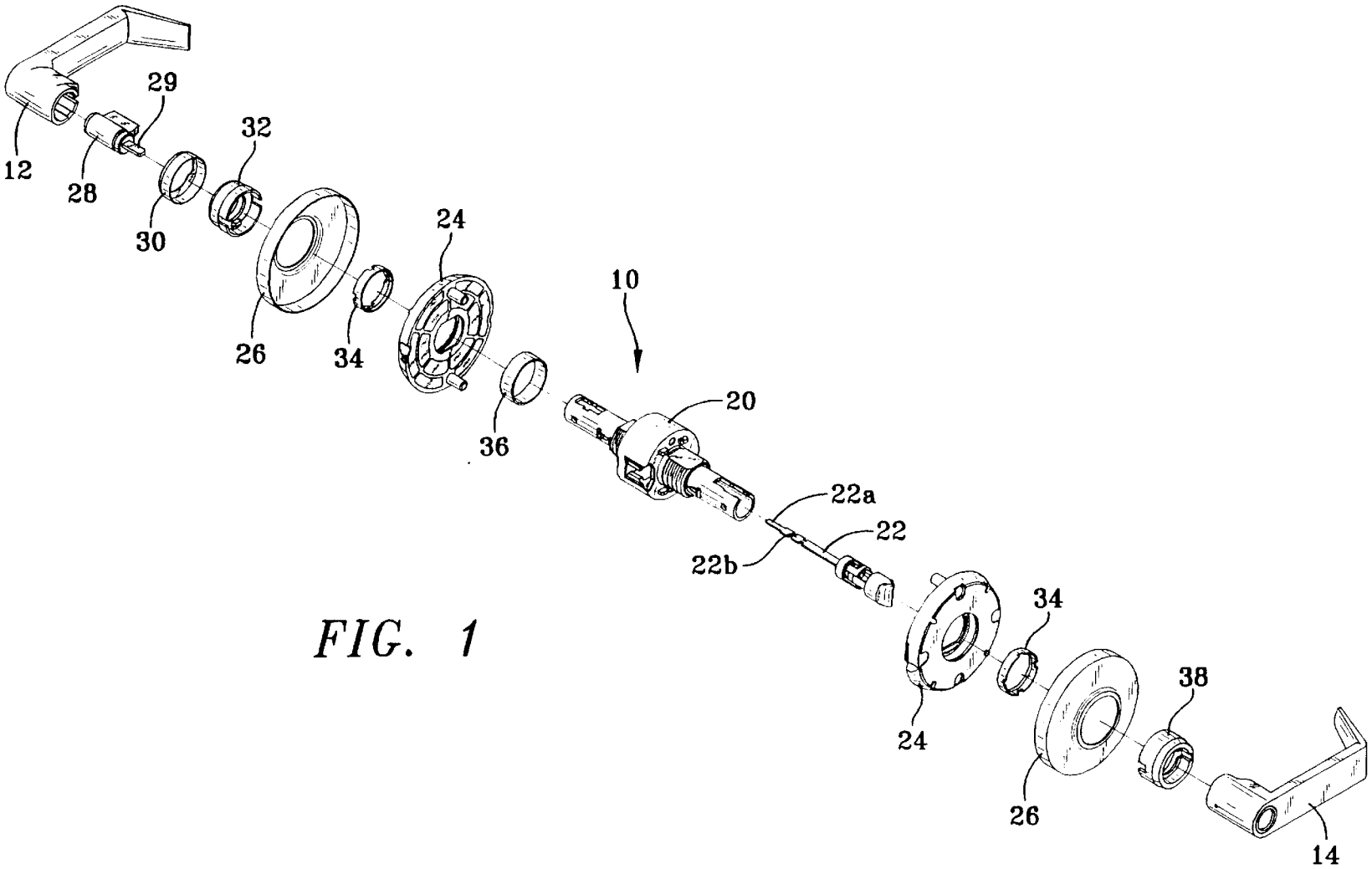
FIG. 1 is an exploded perspective of the door lock with the clutching mechanism of the present invention.
Figure 2:
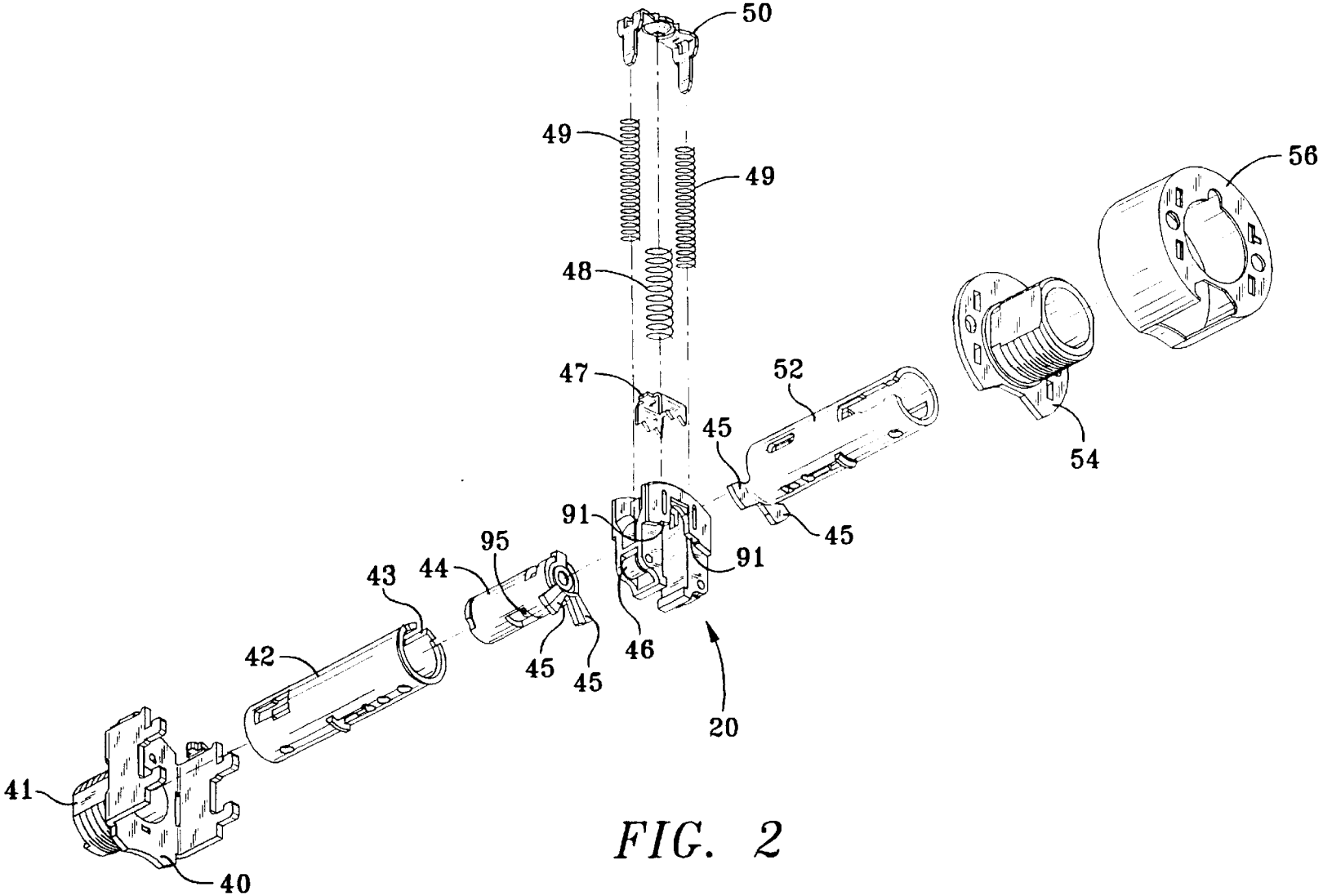
FIG. 2 is an exploded perspective of the chassis shown in FIG.
Figure 6:
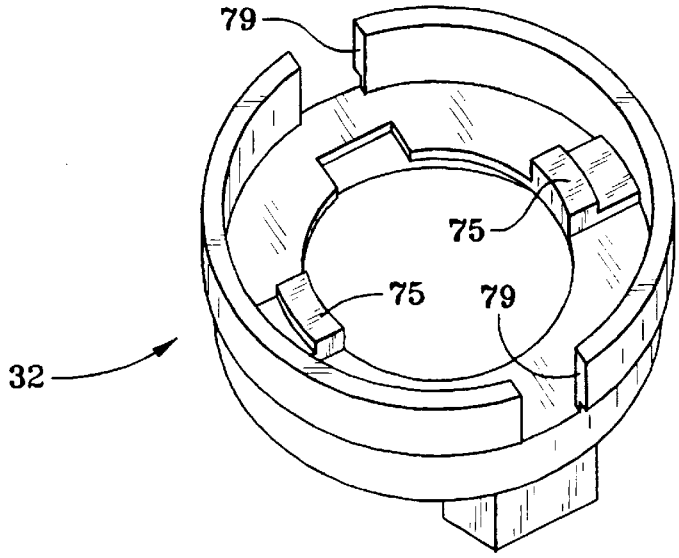
FIG. 6 is an end view of the driver shown in FIG. 1.

FIG. 1 shows a door lock 10 incorporating a clutching mechanism of the present invention. An outer handle 12, preferably a lever, containing a key cylinder 28, with a tailpiece 29 extending therefrom, is connected to the outer spindle 42 which is part of the chassis 20. As shown in FIG. 2, the chassis 20 includes outer and inner hubs 40, 54. A spring cage 24, provided to hold the outer lever 12 in a horizontal position, is attached to the outer hub 40 and retained by castle nut 34. Spacer 36 provides the correct spacing of the spring cage 24 relative to outer lever 12 and outer hub 40. The preferred spring cage 24 is described in Canadian patent application no. 2177550, published Dec. 1, 1996. Flats 41 on outer hub 40 interact with corresponding flats (not shown) in spring cage 24 to prevent the spring cage 24 from rotating relative to chassis 20. An outer driver 32 is keyed to lever 12. The outer driver 32 contains two notches 79 (shown in FIG. 6) which connect to two protrusions on a spring drive plate (not shown) in the spring cage 24. The spring drive plate transmits spring force from the spring cage 24 through the outer driver 32 to the outer lever 12 to hold the lever in a horizontal position when the outer lever 12 has been unclutched from the latch retractor 46. Outer lever 12 is also keyed to an outer spindle 42. Therefor, when the outer lever 12 is turned, the outer spindle 42 is also turned. A rose 26 and driver cap 30 are provided as decorative covers to cover the spring cage 24.

Figure 7:
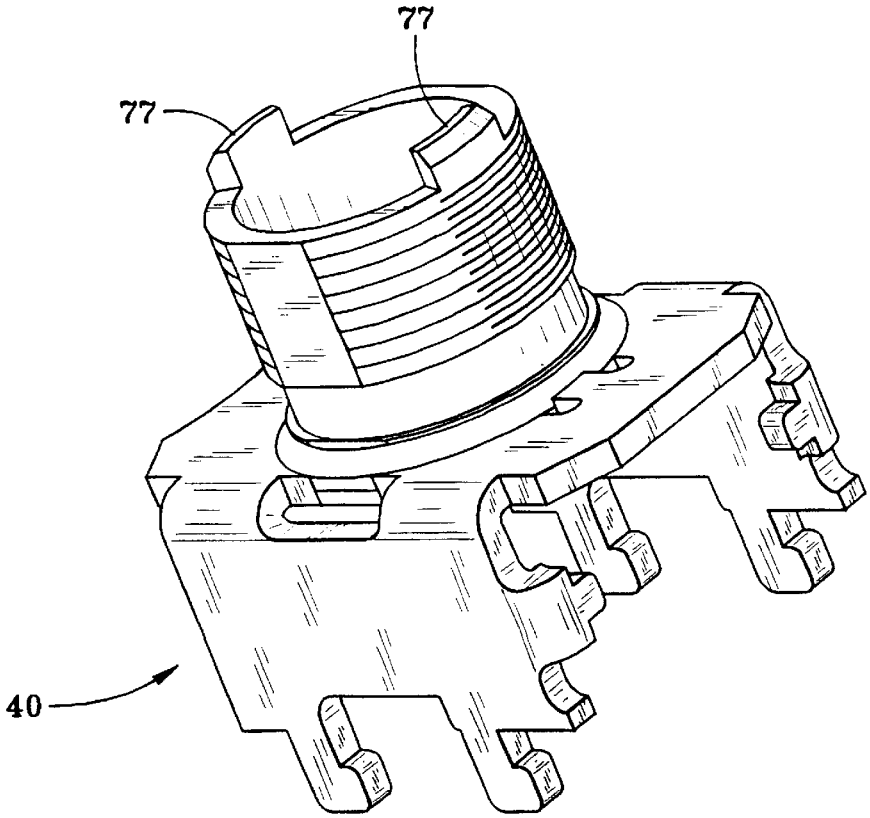
FIG. 7 is an end view of the hub shown in FIG. 1.

The outer driver 32 has two opposed stops 75 (shown in FIG. 6) extending outwardly from the outer driver 32 towards the outer hub 40. Outer hub 40 has two opposed stops 77 (shown in FIG. 7) extending outwardly from the outer hub 40 towards the outer driver 32. As the outer lever 12 is rotated, the outer driver 32 also rotates and the stops 75, 77, known as "hard stops", interact with one another to limit the rotation of the outer lever 12 relative to the chassis 20 to slightly less than 60°. Force from further rotation of the outer lever 12 is imposed on the outer hub 40 and, unless a component of the lock fails, no further force from rotating the outer lever 12 is imposed on either the outer spindle 42 or the key spindle 44.

An inner handle 14, preferably a lever, is keyed to an inner spindle 52, which is part of chassis 20. A second spring cage 24, attached by castle nut 34 to inner hub 54, is provided to hold inner handle 14 in a horizontal position. An inner driver 38 is keyed to the second spring cage 24 in the same manner as outer handle 12 is keyed to the first spring cage 24. In some embodiments, push button assembly 22 is provided to provide locking capability from the inner side of lock 10.

Chassis 20, shown in FIG. 2, includes both a latch retracting mechanism and the clutching mechanism of the present invention. Starting from the middle of chassis 20, a latch retracting mechanism is provided which includes a latch slide 46 which is biased in a latched position by slide springs 49 retained by spring seat 50. In the embodiment shown in FIG. 2, a slide catch 47 and catch spring 48 are provided which co-operate with push button assembly 22. In embodiments which do not use a push button assembly, the slide catch and catch spring are not provided. The interior end of the inner spindle 52 includes two latch scoops 45 which interact with corresponding latch scoops 91 on latch slide 46. When inner handle 14 is turned, inner spindle 52, which is keyed to the inner handle 14, also turns. The latch scoops 45 interact with latch scoops 91 retracting latch slide 46 and thereby retracting the lock latch (not shown). When inner handle 14 is released, spring cage 24 returns the inner handle 14 to a horizontal or home position, the latch scoops 45 rotate back to a neutral position, and slide springs 49 return latch slide 46 and the lock latch to a latched position. A housing 56 is provided to enclose the components of the chassis 20.

Contrary to the design of the inner spindle 52, the outer spindle 42 does not contain any latch scoops. A key spindle 44 fits within outer spindle 42. Key spindle 44 is keyed to outer spindle 42 by a dog arm 66 which fits into slot 43 in outer spindle 42. With dog arm 66 engaging the outer spindle 42, the key spindle 44 is keyed to the outer spindle 42. Rotating outer handle 12 rotates the outer spindle 42 which in turn rotates key spindle 44. Key spindle 44 has two latch scoops 45 at its interior end. Latch scoops 45 interact with latch scoops (not shown) on latch slide 46 causing latch slide 46 to retract thereby retracting the door latch. When outer handle 12 is released, spring cage 24, through outer driver 32, returns the outer handle 12 to a horizontal or home position and thereby causes outer spindle 42 and key spindle 44 to rotate to their neutral positions. Latch springs 49 bias latch slide 46 and door latch to a latched position.

Figure 3:
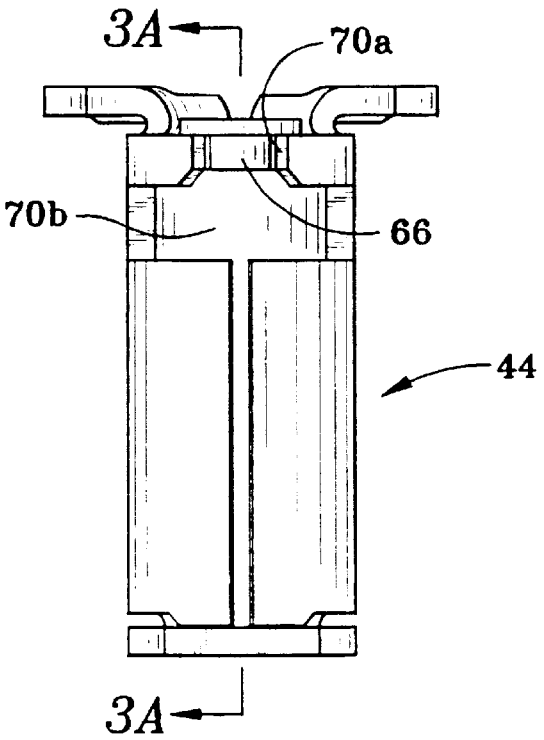
FIG. 3 is a side view of the key spindle and cam shown in FIG. 2, illustrating a dogging arm and T-shaped clutch slot.
Figure 3A:
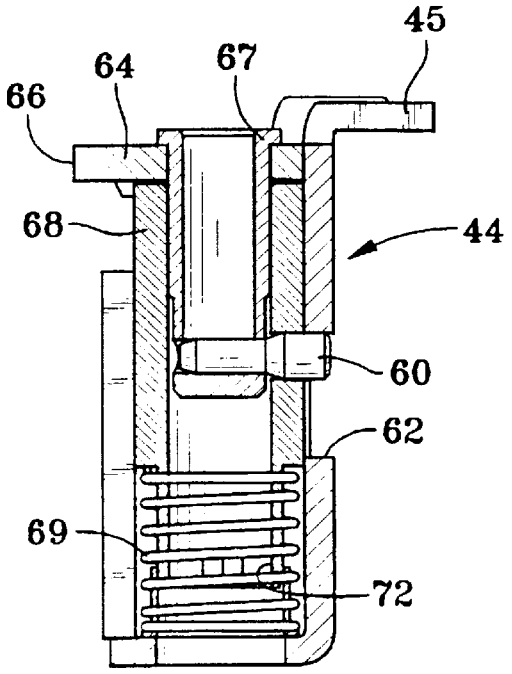
FIG. 3A is a cross-sectional view of the key spindle and cam shown in FIG. 3.
Figure 3B:
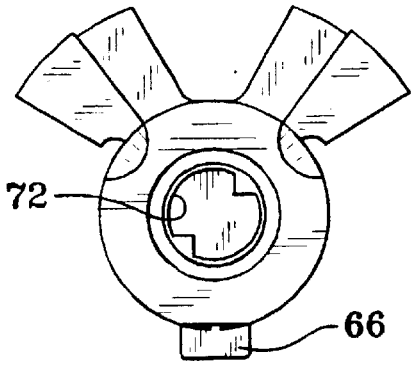
FIG. 3B is an end view of the key spindle and cam shown in FIG. 3 illustrating a lost motion bow-tie shaped plug stem.

Key spindle 44 includes a cam mechanism for linearly moving the dog arm 66 between a clutched (or unlocked) position where key spindle 44 and outer spindle 42 are keyed together and an unclutched (or locked) position where the outer spindle, and the attached outer lever 12, can rotate about 60° without rotating the key spindle 44. FIGS. 3, 3A and 3B show the cam mechanism from the embodiment shown in FIGS. 1 and 2 (known as the office and entry functions). FIGS. 4, 4A, 4B and 4C and 5 show the cam mechanisms from two additional embodiments of the present invention.

The key spindle 44 has a T-shaped slot 70 in the end proximate the latch scoops 45. The dog arm 66 moves linearly within the leg 70*a* (clutched position) of the T-slot 70. When the dog arm 66 has been moved by the cam mechanism to the circumferentially extending head 70*b* of the T-slot 70, the length of the head 70*b* (unclutched position) permits about 60° of rotational movement of the outer spindle 42 and outer handle 12, relative to the key spindle 44. The key spindle 44 shown in FIGS. 3, 3A and 3B consists of a tubular member with latch scoops 45 at one end thereof. Positioned within the tubular member is a rotatable and axially moveable tubular plug bushing 67. At the end of the plug bushing 67, adjacent the latch scoops 45, a dogging member 64 is attached. Preferably, the dogging member 64 is rotatable relative to the plug bushing 67. Attached to the opposite end of the plug bushing 67 is a cam pin 60. The plug bushing 67 fits within tubular plug stem 68 which is biased by spring 69 towards the latch scoop end of the key spindle 44. The plug stem 68 contains a lost motion slot 95 through which a head end of cam pin 60 extends. The key spindle 44 has a cutout 62 which the head of cam pin 60 engages. The cutout 62 shown in FIGS. 2 and 3A is a square. As shown in FIGS. 3A and 3B, the plug stem 68 interior aperture 72 has a bow-tie shape. The tailpiece 29 of key cylinder 28 fits into bow-tie aperture 72. The bow-tie aperture shape in combination with the lost motion slot 95 provides a lost motion connection between the outer handle 12 via tailpiece 29 and key spindle 44. This lost motion connection provides sufficient lost motion between the tailpiece 29 and the key spindle 44 to prevent the key spindle 44 from moving when the outer handle 12 is turned while the dog arm 66 is in the unclutched position, and therefor prevents the latch scoops 45 from engaging the latch slide 46, prior to the hard stops on the outer driver 32 and the outer hub 40 engaging one another thereby preventing further movement of the outer lever 12.

In operation, the lock 10 with the key spindle 44 and cam mechanism shown in FIGS. 3, 3A and 3B, is locked using the push button assembly 22. The plunger bar 22*a* of the push button 22 engages the plug bushing 67. Pushing the push button 22, causes the plunger bar 22*a* to move the plug bushing 67 against spring 69 to move the dog arm 66 towards outer lever 12 thereby placing dog arm 66 in the circumferentially extending head slot 70*b* of the key spindle T-slot 70. With the dog arm 66 in the head slot 70*b*, the outer handle 12 can be rotated about 60° without rotating the key spindle 44. This is the unclutched condition of the lock 10. The hard stops 75, 77, described above, on the outer driver 32 and the outer hub 40 prevent the outer handle 12 from being rotated far enough to cause the dog arm 66 to engage the end of the head slot 70*b*. When the push button 22 is pushed, notches 22*b* on the plunger bar 22*a* engage the spring biased slide catch 47 which prevents the plunger bar 22*a*, and therefor, the dog arm 66 from being moved back to their original (clutched) positions by spring 69. To unlock lock 10, the key cylinder 28 is operated by the key (not shown). When the key cylinder has been turned approximately 60° (this takes up the lost motion between the tailpiece 29 and the bow-tie aperture 72), the plug stem 68 is turned by the tailpiece. The plug stem 6B turns until came pin 60 engages an edge of cutout 62 at which point the key spindle 44 begins to turn, thereby turning latch scoops 45 which causes the latch slide 46 to retract to unlatch the latch. As latch slide 46 retracts, slide catch 47 also retracts releasing push button plunger bar 22*a*. Spring 69 then biases the cam mechanism including plug stem 68 and dog arm 66 to the clutched position where dog arm 66 is positioned in the leg 70*a* of the T-slot 70, thereby clutching the outer handle 12 and outer spindle 42 to key spindle 44 to allow the outer handle 12 to operate the lock 10. In summary, the push button 22 is used to lock the lock 10 and place lock 10 in an unclutched condition and the key cylinder 28 is used to unlock the lock and release the push button 22. In the embodiment shown in FIG. 1, the push button assembly 22 further includes a detent position which, when the push button 22 is pushed and turned, holds the push button 22 in the clutched position. When the push button 22 has been turned, the key cylinder 28 is used to operate the lock 10, but does not release the push button 22 from the detented condition, i.e., movement of the catch slide 47 does not release the plunger bar 22*a*. To restore the lock 10 to the clutched condition, it is necessary to push and turn the push button 22 to release the push button 22 from the detent position. Once the push button 22 has been released from the detent position, spring 69 biases the push button 22 and the dog arm 66 to the clutched position allowing the outer handle 12 to operate the lock 10. In a second embodiment of push button assembly 22 (not shown), the push button assembly 22 does not have a detent function.

Figure 4A:
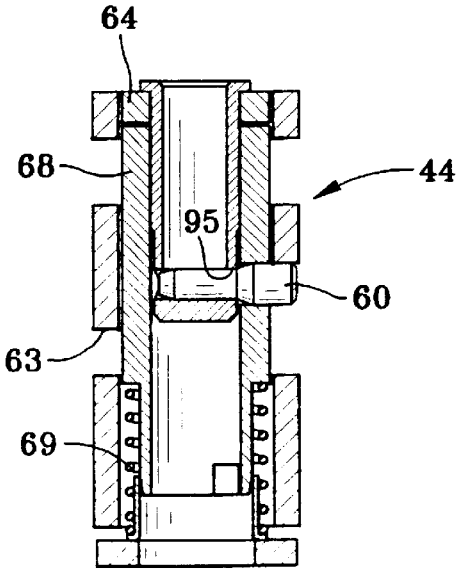
FIG 4A is cross-sectional view of a second embodiment of the key spindle and cam.
Figure 4B:
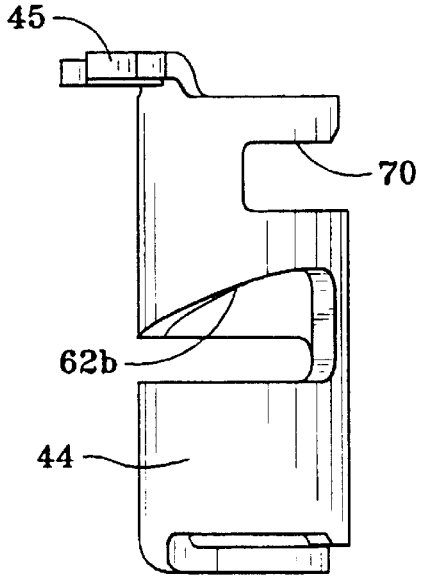
FIG. 4B is a side view of the key spindle shown in FIG. 4A illustrating a portion of the camming cutout.
Figure 4C:
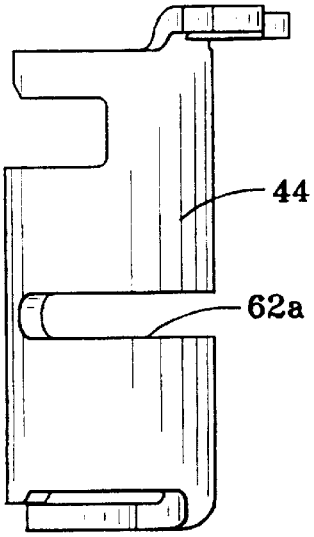
FIG. 4C is an opposite side view of the key spindle shown in FIG. 4A illustrating a second portion of the camming cutout.

A second embodiment of the cam mechanism (known as the class room function) is shown in FIGS. 4A, 4B and 4C. No push button 22 is provided when the class room function cam mechanism is used. The key spindle 44 is provided with a ramped cutout 62 as shown in FIGS. 4B and 4C. The first portion of cutout 62 is a circumferentially extending slot 62*a* which extends into a ramped portion 62*b*. When lock 10, with classroom function, is locked, key cylinder 28 is operated to turn (counterclockwise when looking towards the chassis) tailpiece 29 which in turn engages plug stem 68. After the lost motion of the bow-tie aperture 72 is taken up, the plug stem 68 begins to turn. Once the lost motion of the plug stem lost motion slot 95 is taken up, the cam pin 60 begins to turn. The cam pin 60 follows the wall (closest to latch scoops 45) of the ramped portion 62*b* and begins to move away from the latch scoops 45 causing the plug bushing 67 and attached dogging member 64 to move away from the latch scoops thereby moving the dog arm 66 from the clutched position where the dog arm 66 is in the leg 70*a* of the T-slot 70 to the unclutched position where the dog arm 66 is in the head 70*b* of the T-slot 70. At this point, the cam pin 60 is in the slot portion 62*a* which retains the dog arm 66 in the unclutched position.

To unlock the lock 10, the key cylinder 28 is operated to turn tailpiece 29 clockwise which, after the lost motion of the bow-tie aperture 72 is taken up, begins to turn plug stem 68. After the 35 lost motion between cam pin 60 and lost motion slot 95 is taken up, the cam pin 60 begins to move and follow the wall of cutout 62. When cam pin 60 reaches the ramped portion 62*b*, spring 69 causes the cam pin 60 along with plug stem 68 and dog arm 66 to move towards the latch scoops 45 thereby moving dog arm 66 to the leg 70*a* of T-slot 70, the clutched position of lock 10. In summary, when the key cylinder 28 is operated to lock lock 10, the cam mechanism drives the dog arm 66 to the unclutched position where operation of outer lever 12 does not rotate key spindle 44 to unlatch the latch. When the key cylinder is operated to unlock lock 10, the cam mechanism moves the dog arm 66 to the clutched position where the outer handle 12 does rotate key spindle 44.

Figure 5:
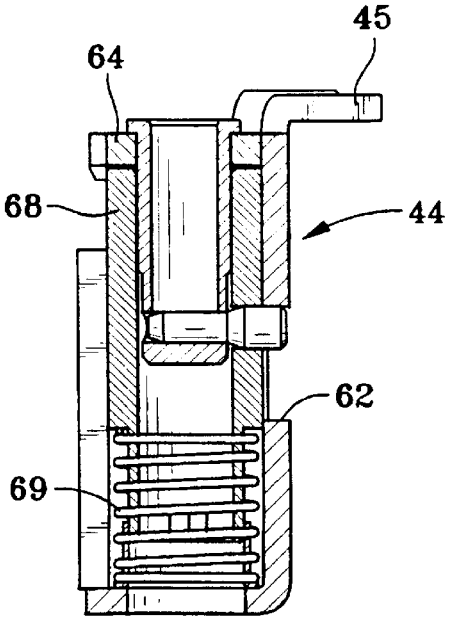
FIG. 5 is a cross-sectional view of a third embodiment of a key spinde cam.

A third embodiment of the cam mechanism (known as the storeroom function) is shown in FIG. 5. In this embodiment, no push button assembly 22 is used. The cam mechanism for the storeroom function is similar to the cam mechanism for the entry function, described above and shown in FIGS. 3, 3A and 3B, except that the dogging member 64 has no dog arm 66. Therefore, in the storeroom function, lock 10 is always unclutched, i.e., outer lever 12 is never connected to, and does not operate, key spindle 44. Key cylinder 28 is operated to rotate tailpiece 29 which in turn, after taking up lost motion through bow-tie aperture 72 and lost motion slot 95, rotates key spindle 44 to operate latch slide 46. Returning the key cylinder 28 to its normal position and removal of the key returns the storeroom function lock to the latched condition.

What is claimed is:

1. A door lock having an inner handle (14); an outer handle (12); a key cylinder (28) positioned within the outer handle; a chassis (20) containing a latch retractor; an inner spindle (52) having latch scoops (45) thereon, the inner spindle latch scoops being operably connected to the latch retractor, the inner spindle being operably connected to the inner handle; an outer spindle (42) keyed to the outer handle; and a tubular key spindle (44) positioned within the outer spindle, the key spindle having two latch scoops (45) thereon, the key spindle latch scoops being operably connected to the latch retractor, characterized in that:

a lost motion means for operatively connecting the key cylinder to the key spindle and for permitting the key cylinder to freely rotate a predetermined degree of rotation relative to the key spindle, the lost motion means comprising the key spindle having an aperture (62) therein and a rotatable plug bushing (67) therein, a cam pin (60) extending radially from the plug bushing into the key spindle aperture, a spring which is free of contact with said plug bushing biasing said plug bushing toward said latch retractor, ends of said cam pin engaging the plug bushing and the key spindle the key cylinder operably engaging the plug bushing whereby, when the key cylinder is rotated, the plug bushing and cam pin rotate, the cam pin contacting an edge of the aperture thereby transmitting the rotary motion of the key cylinder to the key spindle.

2. The door lock according to claim 1, wherein the key spindle further comprises: a plug stem (68) rotatable about the plug bushing an end of the plug stem having an axially extending aperture (72) therein, the plug stem aperture having a bow tie shape, the key cylinder having a tail piece (29) extending therefrom, the tail piece engaging the bow tie shaped aperture, the plug stem having a circumferentially extending aperture therein the cam pin extending through the plug stem circumferential aperture, the bow tie shaped aperture, the plug stem circumferential aperture, the key spindle aperture and cam pin acting as a lost motion connection between the key cylinder tail piece and the plug bushing.

3. The door lock according to claim 1, wherein the key spindle aperture (62) is a square.

4. The door lock according to claim 1, wherein the key spindle has a slot (70*a*, 70*b*) at an end therein, the slot comprising an axially extending slot at one end, the axially extending slot intersecting a circumferentially extending slot (70*b*), the plug bushing has a dogging arm (66) attached thereto and radially extending therefrom into the key spindle slot, the plug bushing being axially moveable within the key spindle between a first position where the dogging arm is positioned within the axially extending slot and a second position where the dogging arm is positioned within the circumferential slot, the dogging arm further extending into an engaging aperture (43) in the outer spindle, and further comprising a clutch means for axially moving the plug bushing between the first position and the second position.

5. The door lock according to claim 4, wherein the clutch means comprises: a push button (22) positioned within the inner handle and inner spindle and operatively connected to the plug bushing, whereby, when the push button is depressed, the push button moves the plug bushing from the first position to the second position.

6. The door lock according to claim 4, wherein the clutch means comprises: the key spindle aperture having a constant width circumferentially extending first slot (62*a*) connected to a second slot (62*b*), the width of the second slot increasing from a first width proximate the first slot to a second width distal the first slot, the second width being greater than the first width, one edge of the second slot extending from and parallel to one edge of the first slot.

7. The door lock according to claim 4, wherein the clutch means comprises: said spring (69) biasing the plug bushing into the first position and an axially and circumferentially extending edge of the aperture engaging the cam pin and having a first portion extending circumferentially and a second portion extending at an angle away from the first portion and towards the key spindle slot, whereby when the key cylinder is rotated from an unlocked position to a locked position, the plug stem, plug bushing and cam pin rotate, the interaction of the cam pin and the aperture edge second portion causing the cam pin and plug bushing to move axially away from the key spindle slot, thereby moving the dogging arm from the first position to the second position.

8. A door lock having an inner handle (14); an outer handle (12); a key cylinder (28) positioned within the outer handle; a chassis (20) containing a latch retractor; an inner spindle (52) having latch scoops (45) thereon, the inner spindle latch scoops being operably connected to the latch retractor, the inner spindle being operably connected to the inner handle; an outer spindle (42) keyed to the outer handle; and a tubular key spindle (44) positioned within the outer spindle, the key spindle having two latch scoops (45) thereon, the key spindle latch scoops being operably connected to the latch retractor, an outer driver (32) connected to the outer handle, characterized in that:

a lost motion means for operatively connecting the key cylinder to the key spindle and for permitting the key cylinder to freely rotate a predetermined degree of rotation relative to the key spindle, the lost motion means comprising the key spindle having an aperture (62) therein and a rotatable plug bushing (67) therein, a cam pin (60) extending radially from the plug bushing into the key spindle aperture, a spring which is free of contact with said plug bushing biasing said plug bushing toward said latch retractor the key cylinder operably engaging the plug bushing whereby, when the key cylinder is rotated, the plug bushing and cam pin rotate, the cam pin contacting an edge of the key spindle aperture thereby transmitting the rotary motion of the key cylinder to the key spindle, the key spindle having a plug stem therein, the plug stem being rotatable about the plug bushing, the plug stem having an axially extending aperture (72) therein, the plug stem aperture having a bow tie shape, the key cylinder having a tail piece (29) extending therefrom, the tail piece engaging the bow tie shaped aperture, the plug stem having a circumferentially extending aperture therein, the cam sin extending through the plug stem circumferential aperture, the bow tie shaped aperture, the plug stem circumferential aperture, the key spindle aperture and cam pin acting as a lost motion connection between the key cylinder tail piece and the plug bushing, the outer driver having a pair of opposed stops (75) projecting towards the chassis, the chassis including an outer hub (40), the outer hub having a pair of opposed stops (77) projecting towards the outer driver, the driver stops interacting with the hub stops to limit rotation of the outer handle relative to the chassis wherein the degree of lost motion provided by the bow tie shaped aperture and the plug stem aperture is greater than the degree of rotation of the outer handle relative to the hub.

* * * * *